US007445164B2

(12) United States Patent
Liaw

(10) Patent No.: US 7,445,164 B2
(45) Date of Patent: Nov. 4, 2008

(54) SPRINKLER

(76) Inventor: Maw-Shinn Liaw, No. 5, Alley 2, Lane 124, Sec. 3, Chien-Kuo Rd., Min-Hsiung Hsiang, Chiayi Hsien (TW)

( * ) Notice: Subject to any disclaimer, the term of this patent is extended or adjusted under 35 U.S.C. 154(b) by 170 days.

(21) Appl. No.: 11/391,048

(22) Filed: Mar. 28, 2006

(65) Prior Publication Data

US 2007/0235560 A1 Oct. 11, 2007

(51) Int. Cl.
*B05B 3/04* (2006.01)

(52) U.S. Cl. ..... 239/240; 239/237; 239/242; 239/222.17; 239/200; 239/587.1; 239/587.5

(58) Field of Classification Search ..... 239/587.1, 239/587.5, 240, 242, 237, 222.17
See application file for complete search history.

(56) References Cited

U.S. PATENT DOCUMENTS

| | | | | |
|---|---|---|---|---|
| 4,986,476 | A * | 1/1991 | Hour | 239/227 |
| 6,164,562 | A * | 12/2000 | Wu | 239/237 |
| 6,808,129 | B1 * | 10/2004 | Wang | 239/231 |
| 6,834,814 | B1 * | 12/2004 | Beckman | 239/227 |
| 7,191,958 | B1 * | 3/2007 | Wang | 239/200 |

* cited by examiner

*Primary Examiner*—Dinh Q Nguyen
(74) *Attorney, Agent, or Firm*—Frommer Lawrence & Haug LLP; Ronald R. Santucci

(57) ABSTRACT

A sprinkler includes a fixed unit, a rotary unit, an impeller, a connector, and a spray head. The fixed unit has a water inlet. The rotary unit is mounted rotatably on and is fluidly communicated with the fixed unit. The impeller rotates the rotary unit and is adapted to be driven by water from the water inlet. The connector is mounted on and is fluidly communicated with the rotary unit. The spray head is mounted on and is fluidly communicated with the connector. The spray head is rotatable relative to the rotary unit so as to change an inclined position of the spray head.

14 Claims, 8 Drawing Sheets

SPRINKLER

BACKGROUND OF THE INVENTION

1. Field of the Invention

The invention relates to a sprinkler, more particularly to a sprinkler in which an inclined position and a spraying range of a spray head can be changed.

2. Description of the Related Art

Referring to FIG. 1, a conventional sprinkler 1 includes a first supporting unit 11, a second supporting unit 12 spaced apart from the first supporting unit 11, an adjusting unit 13 mounted on the second supporting unit 12, a spraying unit 14 mounted between the first supporting unit 11 and the adjusting unit 13, and an installing unit 15 mounted in the spraying unit 14 and including a transmission gear set 151. The spraying unit 14 has a plurality of spraying nozzles 141 spaced apart from each other along a longitudinal direction. The transmission gear set 151 is actuated by water flowing from the second supporting unit 12 through the adjusting unit 13 and the installing unit 15 so as to move the spraying unit 14 around a horizontal axis parallel to the longitudinal direction and to spray water via the spraying nozzles 141.

However, since the spraying unit 14 moves around the horizontal axis, the spraying area is relatively small and uneven.

SUMMARY OF THE INVENTION

Therefore, the object of the present invention is to provide a sprinkler in which a spray head can be adjusted relatively flexibly so as to spray water relatively evenly.

The sprinkler according to this invention includes a fixed unit, a rotary unit, an impeller, a connector, and a spray head. The fixed unit has a water inlet. The rotary unit is mounted rotatably on and is fluidly communicated with the fixed unit. The impeller rotates the rotary unit and is adapted to be driven by water from the water inlet. The connector is mounted on and is fluidly communicated with the rotary unit. The spray head is mounted on and is fluidly communicated with the connector. The spray head is rotatable relative to the rotary unit so as to change an inclined position of the spray head.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
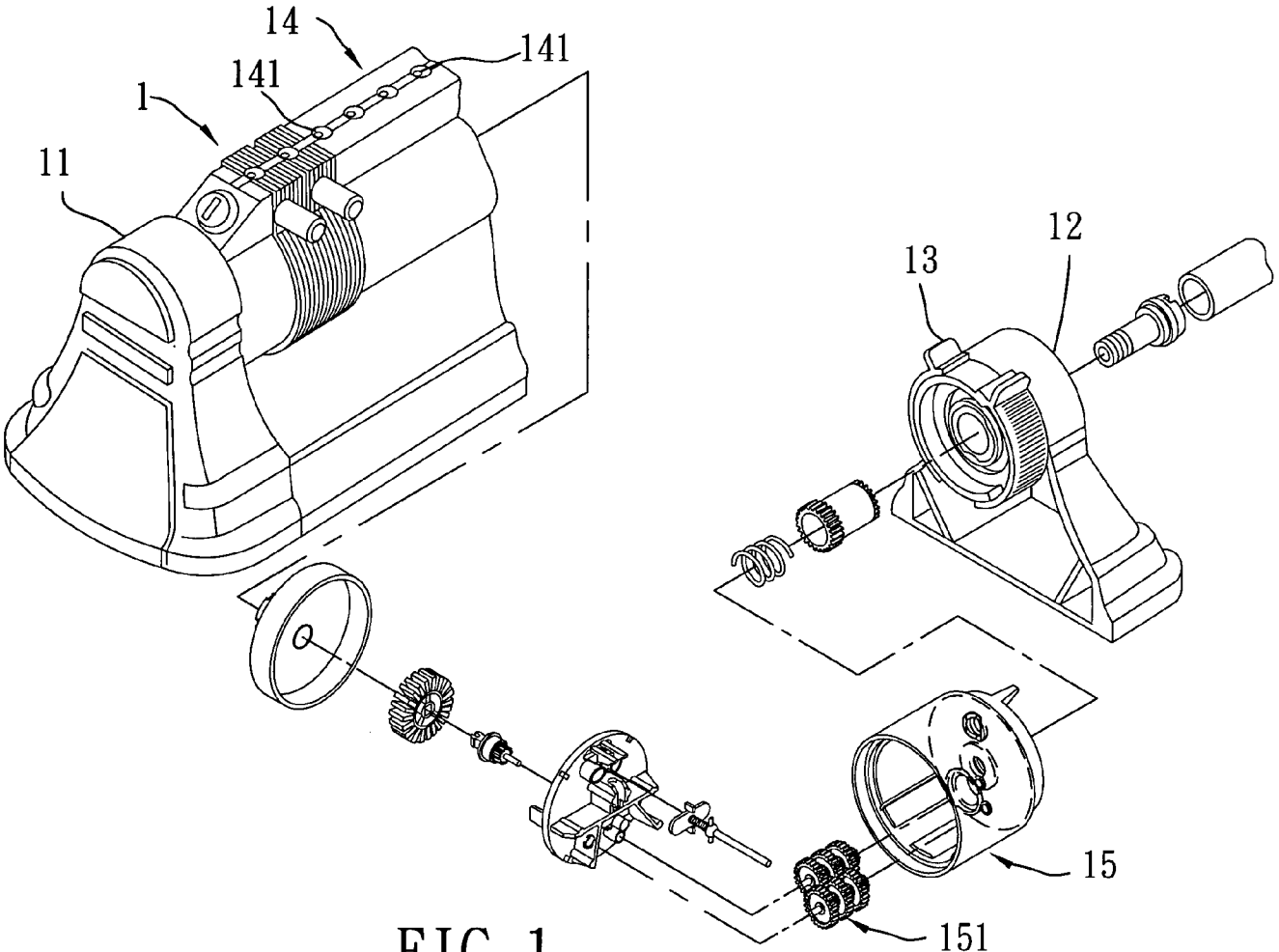
FIG. 1 PRIOR ART
FIG. 1 is an exploded perspective view of a conventional sprinkler.

Before the present invention is described in greater detail, it should be noted that like elements are denoted by the same reference numerals throughout the disclosure.

Figure 2:
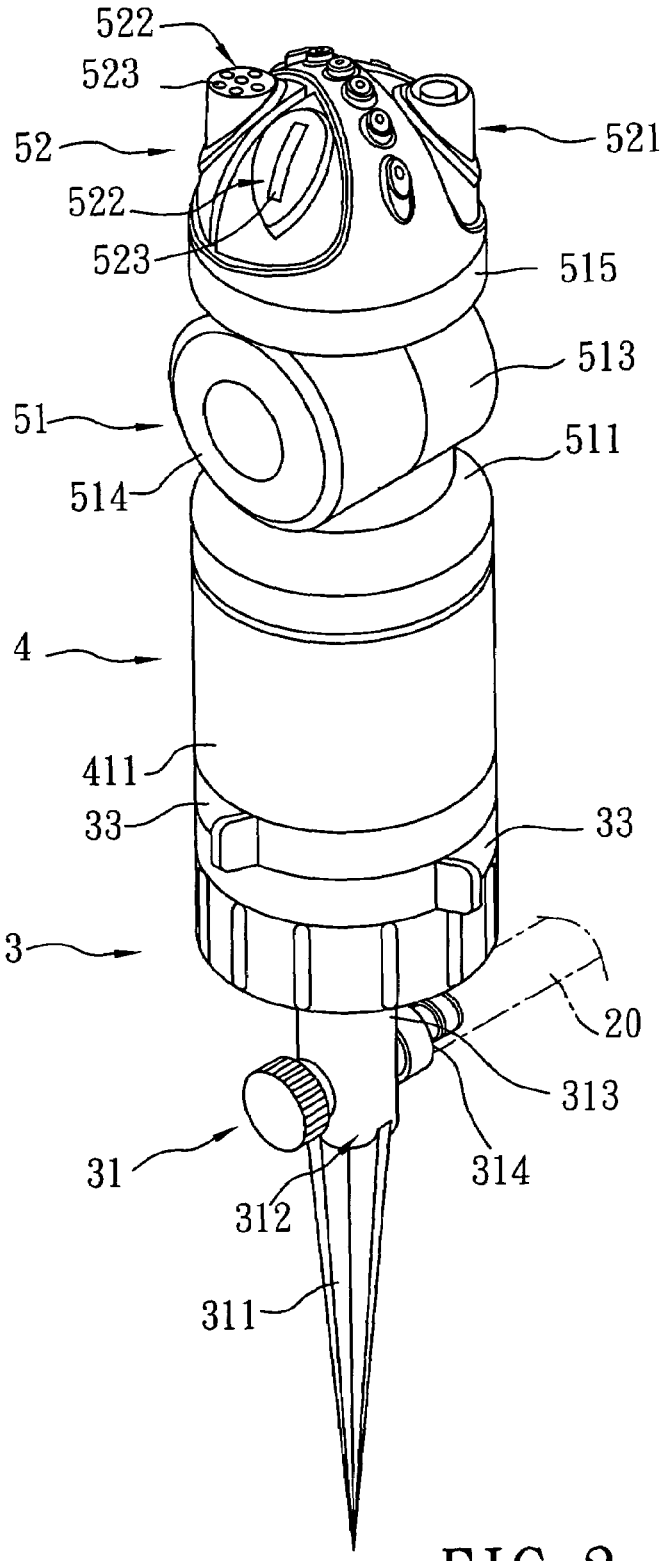
FIG. 2 is a perspective view of the first preferred embodiment of a sprinkler according to this invention.
Figure 3:
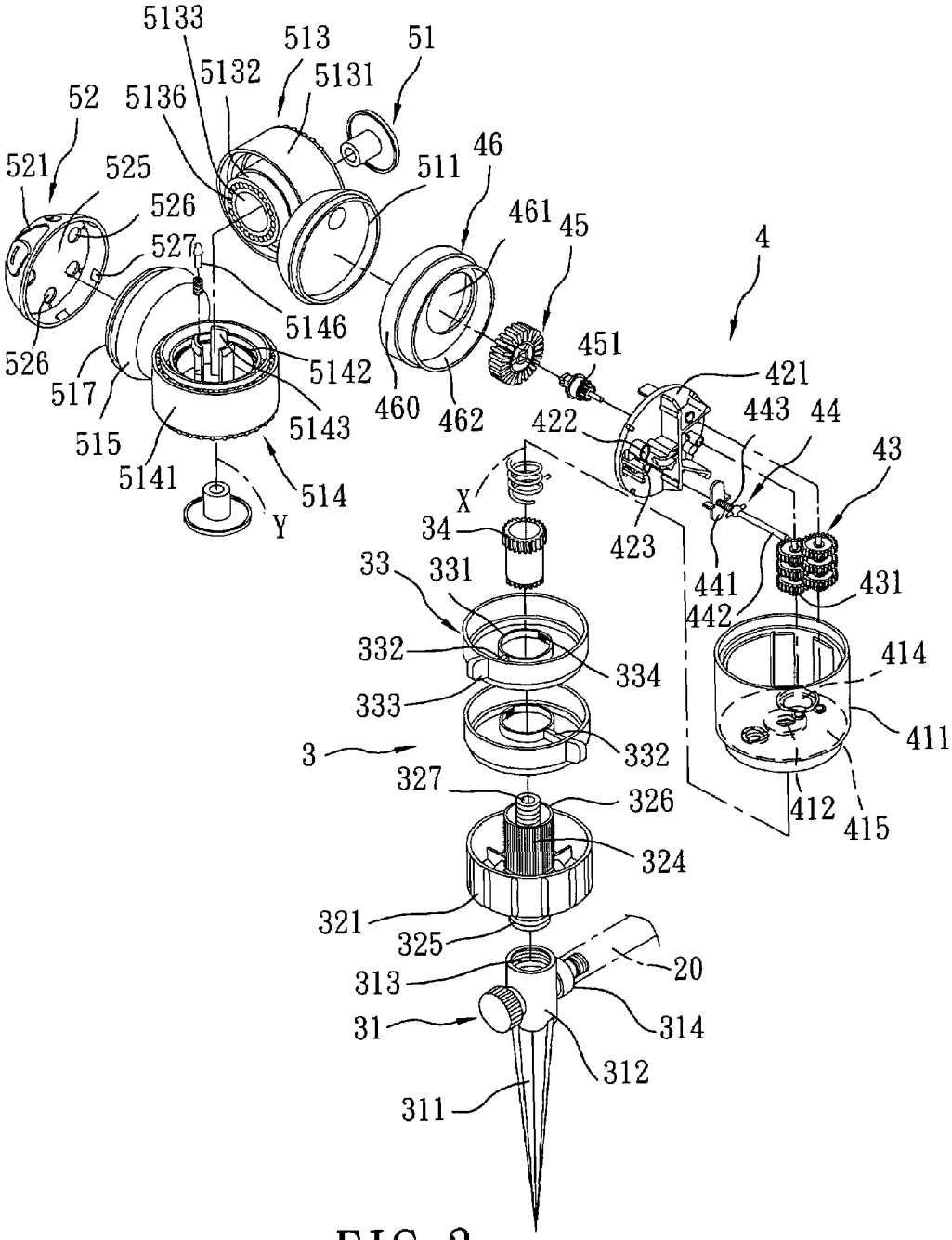
FIG. 3 is an exploded perspective view of the first preferred embodiment.
Figure 4:
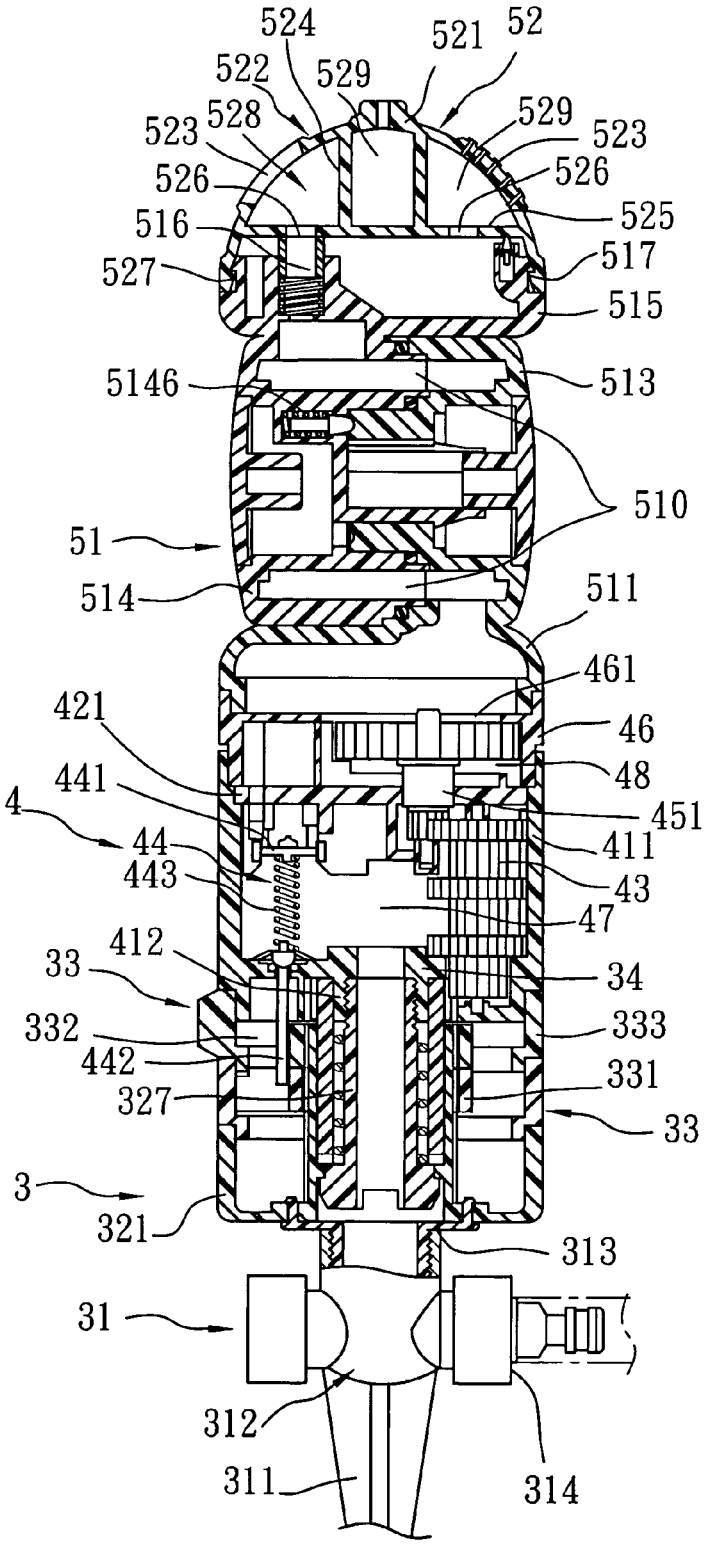
FIG. 4 is a sectional view of the first preferred embodiment.

Referring to FIGS. 2, 3, and 4, the first preferred embodiment of the sprinkler according to this invention is shown to include a fixed unit 3, a rotary unit 4, an impeller 45, a connector 51, and a spray head 52.

The fixed unit 3 includes a water inlet 314 adapted to be connected to a hose 20, a shaft 327 defining a first axis (X), a base housing 321, and a spike body 31 extending downward from the base housing 321. The spike body 31 has a spike pin 311, and a connection pipe 312 connected to the spike pin 311, the base housing 321 and the water inlet 314. The shaft 327 of the fixed unit 3 is tubular, and is connected fluidly to the connection pipe 312. The shaft 327 extends upward from the base housing 321. The spike pin 311 is used for fixing the sprinkler of this invention on a ground. Alternatively, other mechanisms suitable for fixing or mounting the sprinkler on the ground can be used.

The fixed unit 3 further includes an externally toothed tube 326 extending around the shaft 327, two stacked annular adjusting members 33 mounted on the base housing 321, and an inlet tube 325 protruding downward from the base housing 321 and connected fluidly to a top end 313 of the connecting pipe 312. Each of the annular adjusting members 33 has an inner ring 331 extending around the externally toothed tube 326, an outer ring 333 surrounding concentrically the inner ring 331, and an actuator 332 protruding radially from the inner ring 331 to the outer ring 333. The inner ring 331 of each of the annular adjusting members 33 is sleeved around the externally toothed tube 326 and has an internally toothed surface 334 engaging the gear teeth 324 of the externally toothed tube 326 so that the annular adjusting members 33 are engageble and are rotatable about the externally toothed tube 326 so as to adjust an angle defined between the actuators 332 of the annular adjusting members 33.

Figure 5:
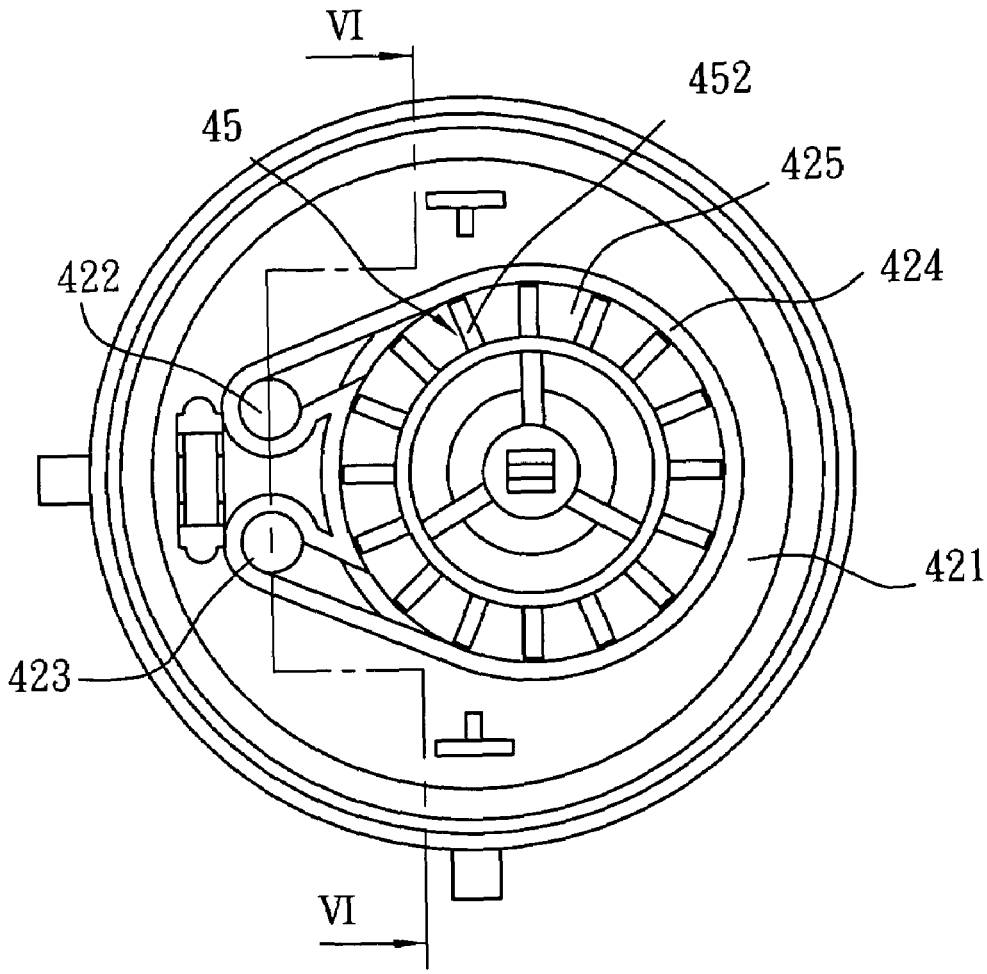
FIG. 5 is a top view of a rotary unit included in the first preferred embodiment.

Referring to FIGS. 3, 4, and 5, the rotary unit 4 is mounted rotatably on and is fluidly communicated with the fixed unit 3. The rotary unit 4 is rotatable about the first axis (X), and includes a rotary housing 411 mounted on top of the base housing 321 of the fixed unit 3, a top cover 46 disposed on top of the rotary housing 411, and a coupler 511 connected to the top cover 46. The rotary housing 411 includes a bottom wall 415, a connecting tube 412 formed in the bottom wall 415, coupled threadedly to the shaft 327, and communicated fluidly with the externally toothed tube 326, and a gear hole 414 formed in the bottom wall 415. The top cover 46 has a substantially cylindrical wall 460, a partition 462 spanning the cylindrical wall 460 between top and bottom ends of the cylindrical wall 460, and a through hole 461 formed in the partition 462 and corresponding to the impeller 45. The coupler 511 is formed substantially as a cup that has a bottom open end connected to the cylindrical wall 460 and a top end opposite to the bottom open end. The shaft 327 of the fixed unit 3 extends upward from the base housing 321 to the rotary housing 411.

The rotary unit 4 further includes an impeller mounting plate 421 mounted inside the rotary housing 411 so as to divide the rotary housing 411 into an upper receiving space 48 and a lower receiving space 47, a planet gear set 43 mounted inside the rotary housing 411, and a sun gear 34 mounted on the shaft 327 and meshing with the planet gear set 43.

The impeller 45 rotates the rotary unit 4, and is adapted to be driven by water from the water inlet 314. The impeller 45 includes a waterwheel 452 mounted rotatably on the impeller mounting plate 421 in the upper receiving space 48 of the rotary housing 411, and a drive gear 451 connected coaxially with the waterwheel 452 and connected to the planet gear set 43. The planet gear set 43 is mounted in the lower receiving space 47 of the rotary housing 411, and is turnable around the sun gear 34 to rotate the rotary housing 411. One planet gear 431 of the planet gear set 43 is disposed in the gear hole 414 of the rotary housing 411 so that the rotary housing 411 rotates along with the planet gear set 43 when the planet gear set 43 rotate around the sun gear 34. The rotating velocity of the rotary housing 411 is determined by the gear ratio of the planet gear set 43.

Furthermore, the impeller mounting plate 421 has a clockwise rotation water passage 422 and a counterclockwise rotation water passage 423, both of which penetrate through the impeller mounting plate 421 and are connected fluidly to the impeller 45. The rotary unit 4 further includes a deflector 44 mounted on the impeller mounting plate 421 and extending downwardly. The deflector 44 has a deflector plate 441 to selectively block one of the clockwise and counterclockwise rotation water passages 422,423, a deflector rod 442 penetrating through the rotary housing 411 and extending between the actuators 332 of the annular adjusting members 33, and a spring 443 interconnecting the deflector plate 441 and the deflector rod 442. Additionally, the impeller mounting plate 421 has a rounded guide rib 424 protruding from the impeller mounting plate 421 and surrounding the waterwheel 452 to define a waterwheel operation region 425. The clockwise and counterclockwise rotation water passages 422, 423 are connected fluidly to the waterwheel operation region 425.

Figure 6:
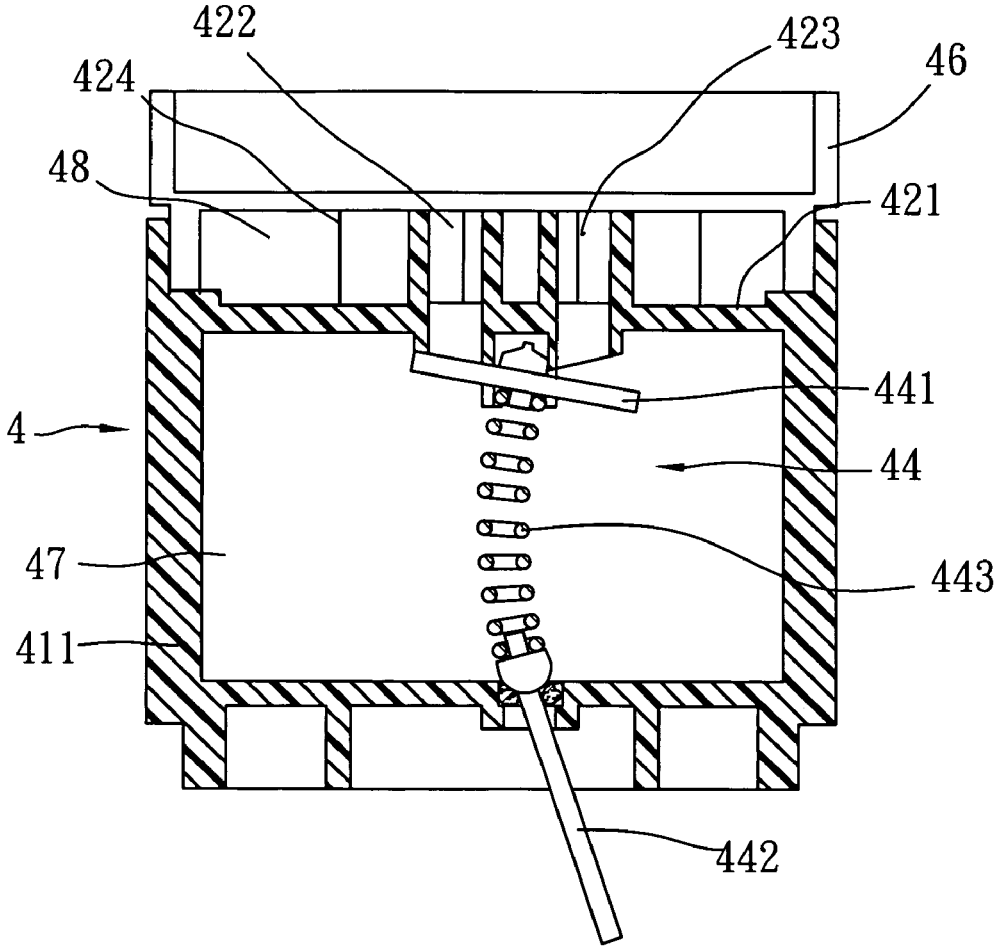
FIG. 6 is a sectional view taken along line VI-VI in FIG. 5.

Referring to FIGS. 4, 5, and 6, water flows from the water inlet 314 through the connection pipe 312 and the shaft 327 into the rotary housing 411. If the clockwise rotation water passage 422 is blocked by the deflector plate 441, water enters through the counterclockwise rotation water passage 423 into the upper receiving space 48 of the rotary housing 411. The waterwheel 452 of the impeller 45 is driven by water flowing from the counterclockwise rotation water passage 423 to rotate counterclockwise, which in turn drives the planet gear set 43 to rotate. Since the sun gear 34 meshes with the planet gear set 43, the rotary housing 411 can rotate clockwise relative to the fixed unit 3.

When the rotary housing 411 rotates clockwise relative to fixed unit 3 until the deflector rod 442 of the deflector 44 abuts against one of the actuators 332 of the annular adjusting members 33, the deflector plate 441 is switched to block the counterclockwise rotation water passage 423. Water enters through the clockwise rotation water passage 422 into the upper receiving space 48 of the rotary housing 411. The waterwheel 452 of the impeller 45 is driven by water to rotate clockwise. Therefore, the rotary housing 411 can rotate counterclockwise relative to the fixed unit 3. Accordingly, the rotary housing 411 can rotate relative to the fixed unit 3 to-and-fro within an angle defined between the actuators 332 of the annular adjusting members 33.

Referring to FIGS. 3 and 4, the connector 51 is mounted on and is fluidly communicated with the rotary unit 4. The connector 51 includes a first connector part 514 rotatable about a second axis (Y) transverse to the first axis (X), and a second connector part 513 connected to and rotatable along the rotary unit 4. The first connector part 514 is coupled to the spray head 52 so as to adjust the inclined position of the spray head 52, and is connected to the second connector part 513 rotatably and adjustably. The second connector part 513 is connected to the top end of the coupler 511.

Each of the first and second connector parts 514, 513 has an outer shell 5141, 5131 and a central joint member 5142, 5132 disposed inside the outer shell 5141, 5131. The central joint members 5142, 5132 of the first and second connector parts 514, 513 are aligned along the second axis (Y), and are interconnected rotatably. The outer shells 5141, 5131 of the first and second connector parts 514, 513 respectively have open ends which are interconnected hermetically. The connector 51 further includes a water space 510 that is formed inside the outer shells 5141, 5131 and around the central joint members 5142, 5132 and that is connected fluidly to the rotary unit 4 and the spray head 52. The central joint member 5142, 5132 and the outer shell 5141, 5131 of each of the first and second connector parts 514, 513 are formed as one piece. The central joint member 5132 of the second connector part 513 has a socket 5133. The central joint member 5142 of the first connector part 514 has resilient hooked members 5143 engaged movably in the socket 5133. Moreover, the central joint member 5132 of the second connector part 513 has a plurality of annularly spaced apart recesses 5136. The central joint member 5142 of the first connector part 514 has a resilient detent 5146 engageable releaseably with one of the recesses 5136 so that the outer shell 5141 of the first connector part 514 can be locked against and move rotationally and relatively to the outer shell 5131 of the second connector part 513.

Referring again to FIGS. 2, 3 and 4, the spray head 52 is mounted on and is fluidly communicated with the connector 51. The spray head 52 is rotatable relative to the rotary unit 4 so as to change an inclined position of the spray head 52.

The spray head 52 includes a first shell 521 that has a plurality of spray regions 522, each of which has a plurality of spray nozzles 523. The spray nozzles 523 in each of the spray regions 522 have a configuration different from that of the other one of the spray regions 522. The first shell 521 further has a plurality of compartments 529 connected fluidly and respectively to the spray regions 522, and a plurality of water inlet holes 526 connected fluidly and respectively to the compartments 529. The first shell 521 further has a barrier plate 525 disposed inside the first shell 521 and cooperating with the first shell 521 to confine a space 528 therebetween, and a plurality of partition plates 524 extending transversely of the barrier plate 525 and dividing the space 528 into the compartments 529. The inlet holes 526 are formed in the barrier plate 525.

The spray head 52 further includes a second shell 515 connected fluidly to the first shell 521. The second shell 515 is connected to and is rotatable along with the first connector part 514. The second shell 515 has a guide passage 516 connected fluidly to the first shell 521 and the first connector part 514. The first shell 521 is rotatable relative to the second shell 515 to selectively align one of the inlet holes 526 with the guide passage 516 so as to select one of the spray regions 522 having a desirable configuration of the spray nozzles 523 for communicating fluidly with the guide passage 516.

Furthermore, the first and second shells 521,515 respectively have open ends which overlap. The open end of the second shell 515 has an annular groove 517. The open end of the first shell 521 has annularly spaced apart projections 527, which engage slidably the annular groove 517 to interconnect rotatably the first and second shells 521, 515.

The water from the rotary unit 4 flows through the through hole 461 of the partition 462, the coupler 511, the water space 510 of the connector 51, the guide passage 516 into a corresponding one of the compartments 529, and then sprays from the spray nozzles 523 of a corresponding one of the spray regions 522. The spray head 52 is actuated by the rotary unit 4 to move to-and-fro within the angle defined between the actuators 332 of the annular adjusting members 33. Moreover, the inclined position of the spray head 52 can be changed by rotating the first connector part 514 relative to the second connector part 513 so as to control the spraying area.

Figure 7:
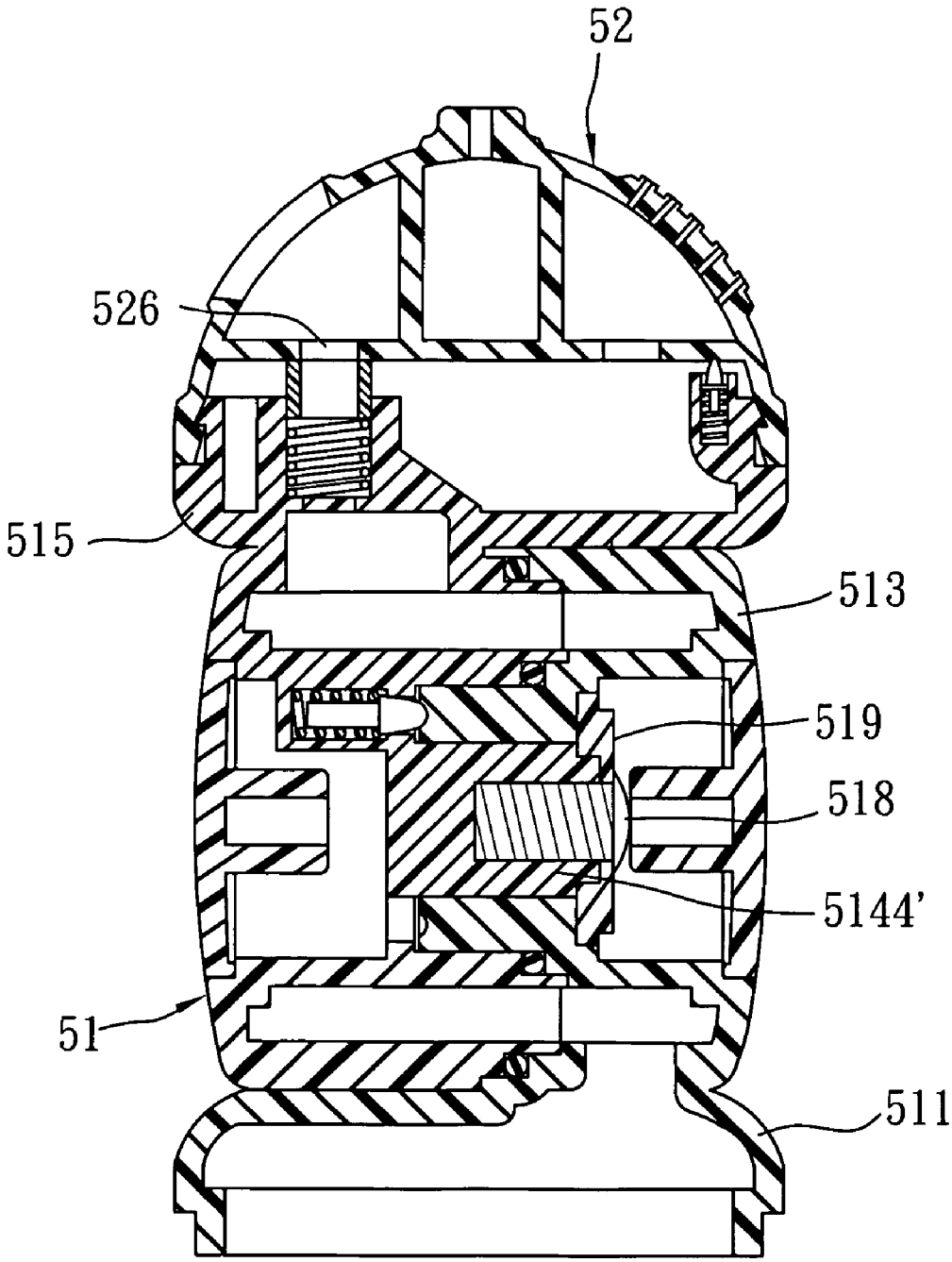
FIG. 7 is a sectional view of a spray head included in the second preferred embodiment of a sprinkler according to this invention.
Figure 8:
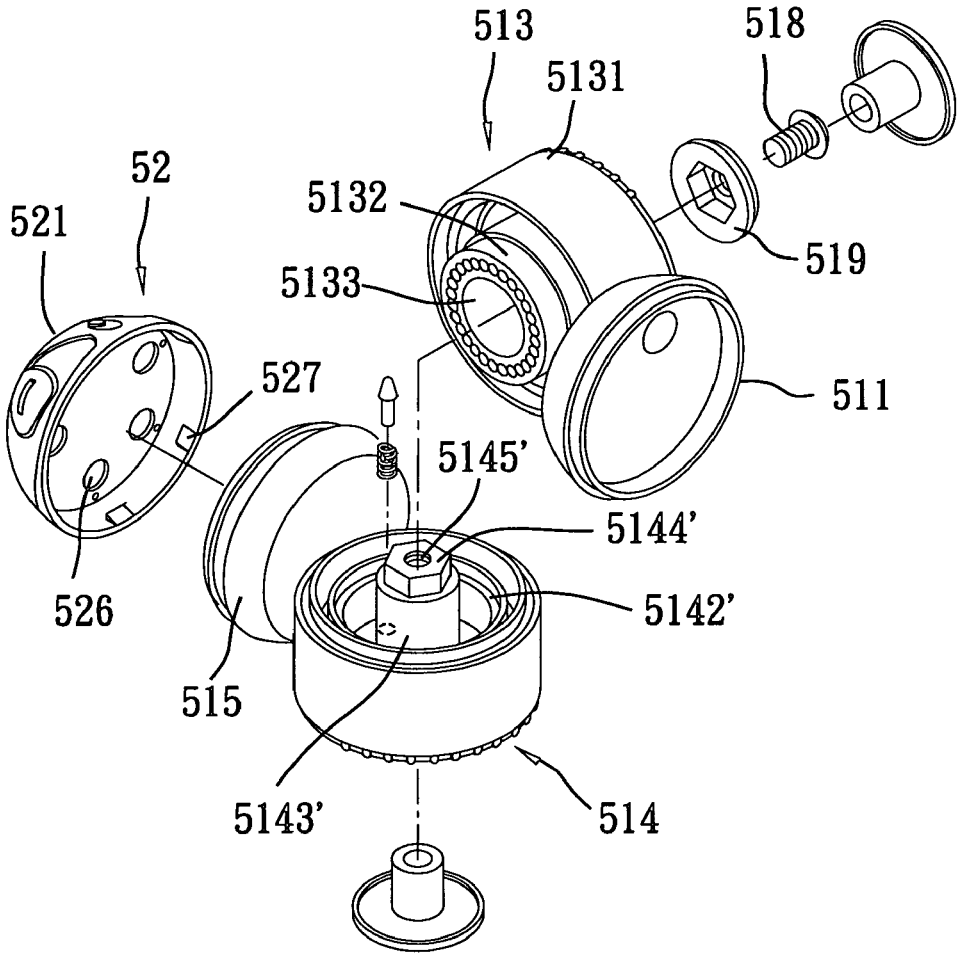
FIG. 8 is an exploded perspective view of the spray head included in the second preferred embodiment.

Referring to FIGS. 7 and 8, the second preferred embodiment of the sprinkler according to this invention is shown to be similar to the first preferred embodiment, except that the central joint member 5132 of the second connector part 513 has a socket 5133. The central joint member 5142' of the first connector part 514' includes a plug 5143' extending into the socket 5133 and having a hexagonal end 5144' and a screw hole 5145', and a fastening member 518, 519 fastened to the hexagonal end 5144' of the plug 5143' so as to hold rotatably the plug 5143' in the socket 5133.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A sprinkler, comprising:

a fixed unit having a water inlet;

a rotary unit mounted rotatably on and fluidly communicated with said fixed unit;

an impeller rotating said rotary unit and adapted to be driven by water from said water inlet;

a connector mounted on and fluidly communicated with said rotary unit; and a spray head mounted on and fluidly communicated with said connector, said spray head being rotatable relative to said rotary unit so as to change an inclined position of said spray head;

wherein said fixed unit has a shaft defining a first axis, said rotary unit being rotatable about said first axis, said connector including a first connector part rotatable about a second axis which is transverse to said first axis, said first connector part being coupled to said spray head so as to adjust the inclined position of said spray head;

wherein said connector further includes a second connector part connected to and rotatable along with said rotary unit, said first connector part being connected to said second connector part rotatably and adjustably; and wherein each of said first and second connector parts has an outer shell and a central joint member disposed inside said outer shell, said central joint members of said first and second connector parts being aligned along said second axis and being interconnected rotatably, said outer shells of said first and second connector parts respectively having open ends which are interconnected hermetically, said connector further including a water space that is formed inside said outer shells and around said central joint members and that is connected fluidly to said rotary unit and said spray head.

2. The sprinkler as claimed in claim 1, wherein said central joint member and said outer shell of each of said first and second connector parts are formed as one piece.

3. The sprinkler as claimed in claim 2, wherein one of said central joint members has a socket, the other one of said central joint members having resilient hooked members engaged movably in said socket.

4. The sprinkler as claimed in claim 2, wherein one of said central joint members has a socket, the other one of said central joint members having a plug extending into said socket and a fastening member holding rotatably said plug in said socket.

5. The sprinkler as claimed in claim 2, wherein one of said central joint members has a plurality of annularly spaced apart recesses, the other one of said central joint members having a resilient detent engageable releaseably with one of said recesses.

6. The sprinkler as claimed in claim 1, wherein said spray head includes a first shell that has a plurality of spray regions, each of which has a plurality of spray nozzles, said spray nozzles in each of said spray regions having a configuration different from that of the other one of said spray regions.

7. The sprinkler as claimed in claim 6, wherein said first shell further has a plurality of compartments connected fluidly and respectively to said spray regions, and a plurality of water inlet holes connected fluidly and respectively to said compartments.

8. The sprinkler as claimed in claim 7, wherein said first shell further has a barrier plate that is disposed inside said first shell and that cooperates with said first shell to confine a space therebetween, and a plurality of partition plates extending transversely of said barrier plate and dividing said space into said compartments, said inlet holes being formed in said barrier plate.

9. The sprinkler as claimed in claim 7, wherein said spray head further includes a second shell connected fluidly to said first shell, said second shell being connected to and being rotatable along with said first connector part.

10. The sprinkler as claimed in claim 9, wherein said second shell has a guide passage connected fluidly to said first shell and said first connector part, said first shell being rotatable relative to said second shell to selectively align one of said inlet holes with said guide passage.

11. The sprinkler as claimed in claim 10, wherein said first and second shells respectively have open ends which overlap, said open end of said second shell having an annular groove, said open end of said first shell having annularly spaced apart projections, said projections engaging slidably said annular groove to interconnect rotatably said first and second shells.

12. The sprinkler as claimed in claim 1, wherein said fixed unit has a base housing, and a spike body extending downward from said base housing, said spike body having a spike pin, and a connection pipe connected to said spike pin, said base housing and said water inlet.

13. A sprinkler, comprising:

a fixed unit having a water inlet;

a rotary unit mounted rotatably on and fluidly communicated with said fixed unit;

an impeller rotating said rotary unit and adapted to be driven by water from said water inlet;

a connector mounted on and fluidly communicated with said rotary unit; and a spray head mounted on and fluidly communicated with said connector, said spray head being rotatable relative to said rotary unit so as to change an inclined position of said spray head;

wherein said fixed unit has a shaft defining a first axis, said rotary unit being rotatable about said first axis, said connector including a first connector part rotatable about a second axis which is transverse to said first axis, said first connector part being coupled to said spray head so as to adjust the inclined position of said spray head;

wherein said connector further includes a second connector part connected to and rotatable along with said rotary unit, said first connector part being connected to said second connector part rotatably and adjustably; and wherein said rotary unit includes a rotary housing, a top cover disposed on top of said rotary housing, and a coupler connected to said top cover and said second connector part, said top cover having a substantially cylindrical wall, a partition spanning said cylindrical wall between top and bottom ends of said cylindrical wall, and a through hole formed in said partition, said coupler being formed substantially as a cup that has a bottom open end connected to said cylindrical wall and a top end connected to said second connector part.

14. A sprinkler, comprising:

a fixed unit having a water inlet;

a rotary unit mounted rotatably on and fluidly communicated with said fixed unit;

an impeller rotating said rotary unit and adapted to be driven by water from said water inlet;

a connector mounted on and fluidly communicated with said rotary unit; and a spray head mounted on and fluidly communicated with said connector, said spray head being rotatable relative to said rotary unit so as to change an inclined position of said spray head;

wherein said fixed unit has a shaft defining a first axis, said rotary unit being rotatable about said first axis, said connector including a first connector part rotatable about a second axis which is transverse to said first axis, said first connector part being coupled to said spray head so as to adjust the inclined position of said spray head;

wherein said connector further includes a second connector part connected to and rotatable along with said rotary unit, said first connector part being connected to said second connector part rotatably and adjustably; and wherein said fixed unit includes a base housing, said rotary unit includes a rotary housing mounted on top of said base housing, said shaft of said fixed unit extending upward from said base housing to said rotary housing, said rotary unit further including an impeller mounting plate mounted inside said rotary housing, a planet gear set mounted inside said rotary housing, and a sun gear mounted on said shaft and meshing said planet gear set, said impeller including a waterwheel mounted rotatably on said impeller mounting plate, and a drive gear connected coaxially with said waterwheel and connected to said planet gear set, said planet gear set being turnable around said sun gear to rotate said rotary housing.

* * * * *